US005368510A

United States Patent [19]

Richard

[11] Patent Number: 5,368,510

[45] Date of Patent: Nov. 29, 1994

[54] TROLLING VALVE SAFETY DEVICE

[76] Inventor: Andre L. Richard, 741 Kanuga Dr., West Palm Beach, Fla. 33401

[21] Appl. No.: 75,296

[22] Filed: Jun. 11, 1993

[51] Int. Cl.[5] ..... B63H 21/21

[52] U.S. Cl. ..... 440/84; 440/86

[58] Field of Search ..... 440/84, 86, 75, 87; 114/145 R, 255; 192/87.19; 74/DIG. 8, 473 R, 480 B, 501 R, 500.5, 501.6

[56] References Cited

U.S. PATENT DOCUMENTS

| | | | |
|---|---|---|---|
| 2,785,584 | 3/1957 | Hambleton | 440/87 |
| 3,823,801 | 7/1974 | Arnold | 192/87.19 |
| 3,938,637 | 2/1976 | Murakami | 192/87.19 |
| 4,836,809 | 6/1989 | Pelligrino | 440/84 |

*Primary Examiner*—Edwin L. Swinehart
*Attorney, Agent, or Firm*—Quarles & Brady

[57] ABSTRACT

A trolling valve safety device limits actuation of a boat engine throttle from its idle position during use of a trolling valve, and vice versa. The trolling valve safety device preferably includes a rotating control plate having mounts for throttle cables so that throttle actuation requires plate rotation. This rotation can be limited by a cam slider which slides under force of trolling valve cables and provides a cam member that inserts in control slots of the control plate. The cam member is positioned in a locking radial slot when the trolling valve is engaged and thereby limits engine throttling. The cam member is positioned in a releasing arcuate position when the trolling valve is disengaged and thereby permits rotation of the plate and associated engine throttling. A stop pin can also extend from the plate to selectively permit or limit rotation of the plate by alignment or disalignment with a groove in the cam slider.

11 Claims, 5 Drawing Sheets

TROLLING VALVE SAFETY DEVICE

FIELD OF THE INVENTION

The present invention relates generally to boat engine control equipment. More particularly, the invention relates to apparatus for controlling boat engine fuel throttles and trolling valves.

BACKGROUND OF THE INVENTION

The engine fuel throttle of a marine engine and the associated speed of the boat are typically controlled by a throttle lever at the helm of the boat. The throttle lever typically manipulates the engine throttle assembly through cabling, either mechanically or electromechanically.

The engine controls can also include a clutch control lever that controls the clutch assembly of the engine. The clutch assembly includes clutch plates which are forced together by high fluid pressure to transmit engine power to the propeller drive train.

In some boats, the engine controls further include a trolling valve, which relieves varying levels of the fluid pressure that releases and compresses the clutch plates and allows slippage in the power transmission through the marine gear to the drive train. By manipulating the trolling valve, the idle speed of the boat can be adjusted from a normal idle speed of four to seven knots down to perhaps one knot to enhance fishing conditions and the like.

Use of the trolling valve, however, presents a significant danger of marine gear damage. The typically high oil pressure and associated oil circulation rate around the marine gear during normal operation transfers a significant amount of heat generated by the marine gear away from the marine gear. However, when the pressure is reduced by the trolling valve, the flow rate is reduced, and the marine gear can overheat as a result of inadequate heat dissipation, when the engine is reeved above factor limits during use of the trolling valve.

SUMMARY OF THE INVENTION

It is an object of the invention to provide a system to limit marine gear damage when using a trolling valve.

It is another object of the invention to provide a gear protection system that is rugged and reliable in marine environments.

It is yet another object of the invention to provide a gear protection system that can readily be retrofitted to an existing engine control system.

It is still another object of the invention to provide a gear protection system that can provide its function mechanically or electromechanically.

These and other objects are achieved by a trolling valve safety device that automatically limits actuation of the engine throttle from its idle position when the engine's trolling valve is engaged, and vice versa. The trolling valve safety device includes means for releasably limiting actuation of the engine throttle and means for locking the limiting means when the trolling valve is engaged and releasing the limiting means when the trolling is disengaged. The limiting means preferably prevents actuation of the throttle from its idle position, except for relatively minor variations in motion due to cable play and part gap tolerances. It is, however, within the intended scope of the invention that the limiting means limits actuation of the throttle during trolling valve use to a level below the threshold for marine gear burnout.

The trolling valve safety device preferably includes a circular control plate rotatably mounted on a support, which is preferably secured to the boat structure in the engine compartment. The control plate provides cable mounts for connecting to cables that control the engine throttle assembly. One cable connects to the engine throttle assembly, and the other connects to the throttle control at the helm. The mounts are preferably diametrically opposed so that actuation of the engine throttle through the cables requires rotation of the control plate.

The engine throttle actuation can thus be controlled by limiting rotation of the control plate as a function of the operational status of the trolling valve. Preferably, the status of the trolling valve is coordinated with the locking of the control plate by the interaction of a cam member that slides in a slot formed in the control plate. The cam member is preferably mounted on a cam slider that slides the cam member in and out of a plate locking position as the cam slider is slid by the control cables for the trolling valve.

The control slot in the control plate preferably includes a releasing arcuate section about the rotational axis of the control plate and a locking radial section extending from an end of the arcuate section toward the axis. The cam member travels in the control slot and is rotationally fixed relative to the support. Thus, positioning of the cam member in the arcuate portion of the slot permits rotation of the control plate while positioning of the cam member in the radial slot blocks rotation.

The cam member is preferably mounted on a cam slider that is rotationally fixed relative to the support base. The cam slider interconnects the control cables for the trolling valve. As the cables move, the cam slider moves. To coordinate the idle position of the engine throttle with the actuation of the trolling valve, the cam slider and the cam member can be positioned relative to the control plate so that the cam member aligns with the locking radial portion of the slot when the engine throttle is idling.

When the cam member is located in the releasing arcuate section, the control plate is free to rotate and permit actuation of the engine throttle. Correspondingly, the cam slider cannot slide when the cam member is in the arcuate portion and thereby limits actuation of the trolling valve.

When the cam member is located in the locking radial slot, sliding of the cam slider and associated actuation of the trolling valve is possible, but the rotation of the control plate and the associated actuation of the engine throttle is limited.

The locking means can include a stop pin extending from the control plate for engagement with the cam slider. The cam slider can provide a groove that aligns with the stop pin when throttling is to be permitted to allow rotation of the plate and disaligns with the stop pin when throttling is to be limited to stop rotation of the plate.

The locking means can include a stop pin extending from the control plate for engagement with the cam slider. The cam slider can provide a groove that aligns with the stop pin to allow rotation of the plate when throttling is to be permitted. The cam slider can be moved with actuation of the trolling valve to disalign the channel with the stop pin to prevent rotation of the plate when throttling is to be limited.

The cam slider can be controlled by control cables for the trolling valve. Alternatively, an electromechanical actuator can move the cam slider and the cable to the trolling valve in response to a signal from the boat controls.

Thus, the present invention provides an automatic system for avoiding, or at least limiting, the potentially damaging use of a boat engine throttle while using a trolling valve, and vice versa.

BRIEF DESCRIPTION OF THE DRAWINGS

A more detailed understanding of the invention and its preferred embodiments can be gained from a reading of the following description in connection with the accompanying drawings, in which.

DESCRIPTION OF THE PREFERRED EMBODIMENTS

Figure 1:
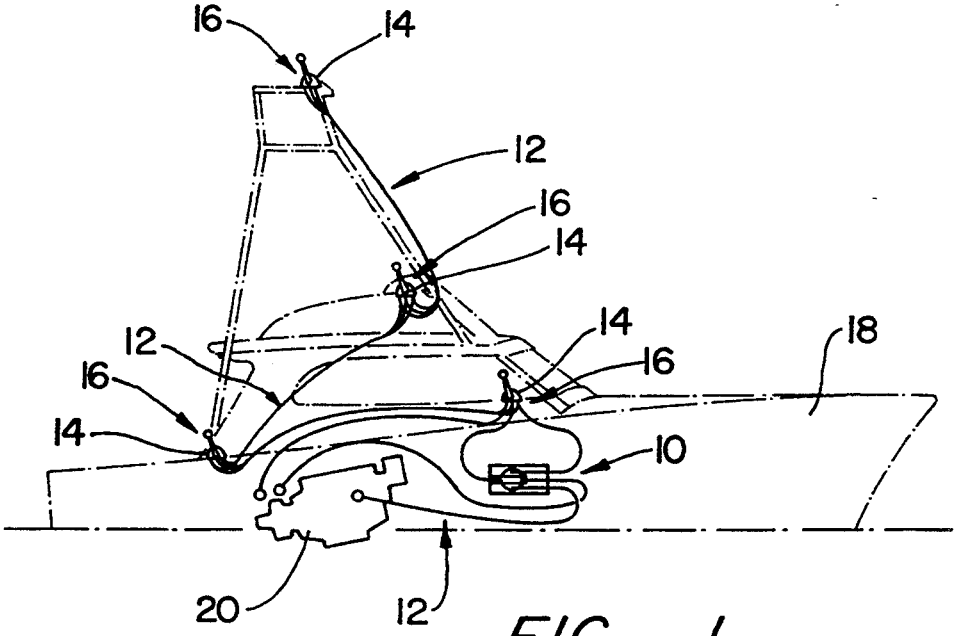
FIG. 1 is an illustration of an overall placement of a boat engine control system utilizing the trolling valve safety device.

The present invention is directed to marine equipment for reducing the likelihood of marine gear burnout during use of a trolling valve of the marine gear. Referring to the figures, and particularly FIG. 1, a trolling valve safety device 10 is preferably installed along the control cable lines 12 between the engine controls 14, located at the various stations 16 on a boat and the boat engine 20. The trolling valve safety device 10 can be entirely mechanical in operation or can be electromechanical.

Figure 2:
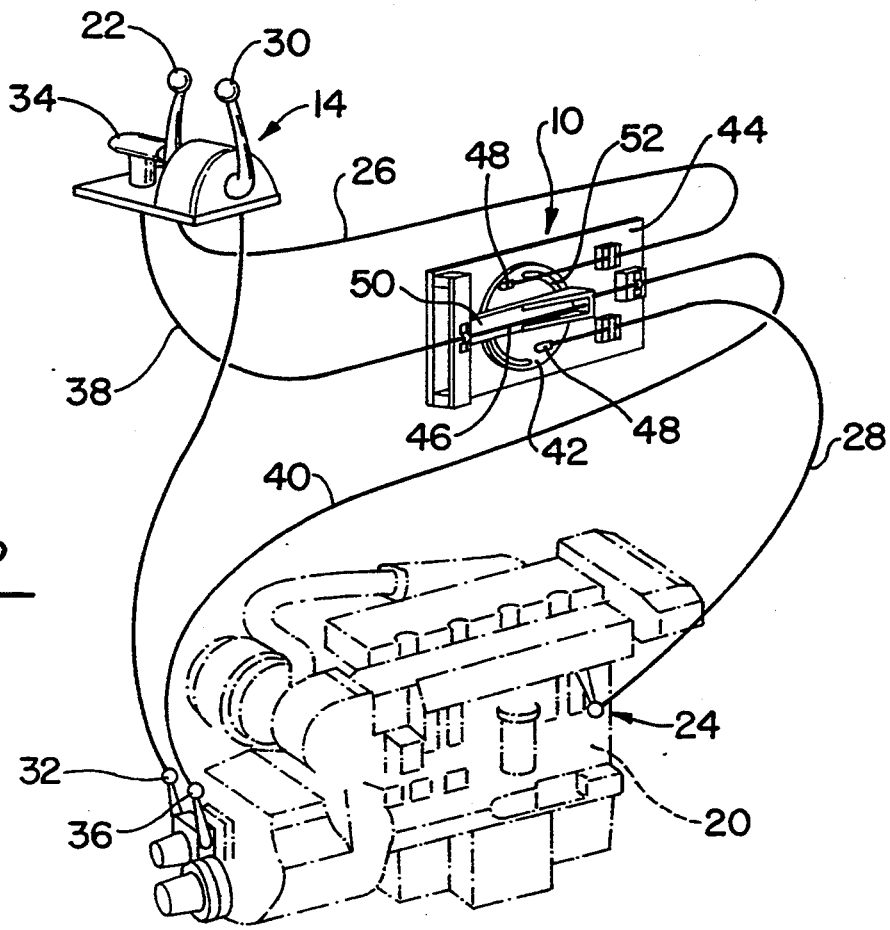
FIG. 2 is a perspective view of a boat engine control system that includes a preferred embodiment of the trolling valve safety device.

Referring to FIG. 2, the engine controls 14 can include a throttle control lever 22 for actuating the engine fuel throttle assembly 24 through throttle control cables 26, 28. The engine controls 14 can also include a clutch control lever 30 directly cabled to the engine clutch assembly 32. The engine controls 14 can further include a trolling valve control 34, which actuates a trolling valve assembly 36 on the engine 20 to adjust the pressure of the oil that compresses the engine's clutch plates and thereby vary the engine drive output and associated boat trolling speed.

The trolling valve safety device 10 serves as a control junction for the control cables 26, 28 extending from the throttle control lever 22 to the engine throttle assembly 24 and for trolling valve control cables 38, 40 extending from the trolling valve control 34 to the trolling valve 36. The trolling valve safety device 10 generally includes means for releasably limiting actuation of the engine throttle when the trolling valve is engaged and means for locking the limiting means when the trolling valve is engaged or actuated and releasing the limiting means when the trolling valve is disengaged.

The limiting means preferably prevents actuation of the throttle from its idle position, except for relatively minor variations in motion due to cable play and part gap tolerances. It is, however, within the intended scope of the invention that the limiting means limits actuation of the throttle during trolling valve use to a level below the threshold for marine gear burnout.

As used herein, preventing refers to a limiting of significant motion of the throttle assembly during use of the tolling valve and limiting of significant motion of the trolling valve during use of the throttle. Play in control cables and variations in parts due to manufacturing tolerances can permit some actuation motion to occur despite locking by the structure of the invention. Such play motion is considered negligible if the associated engine RPM levels are below the threshold for marine gear burnout for the particular installation. In some environments, one quarter of maximum throttle may correspond to the engine level limit while others may be significantly less or significantly higher, to as much as one half of maximum throttle. The particular threshold to avoid marine gear burnout on a particular boat can typically be found from the manufacturer of the boat engine or the marine gear supplier.

The limiting means preferably includes a throttle control plate 42 rotatably mounted on a support 44 for rotation relative to the support 44 about a central pivot axis 46. The control plate 42 is preferably circular and made of aluminum, but can be constructed in other geometries and materials capable of rotating relative to the support 44, which is preferably a mounting plate made of aluminum and can otherwise be provided by structure suitable for mounting to the framework of a boat engine compartment.

The preferred throttle control plate 42 provides cable mounts 48 for connection to the throttle control cables 26, 28. One cable 26 is connected at its opposite end to the throttle control lever 22, and the other cable 28 is connected to the engine throttle assembly 24. The cable mounts 48 are preferably diametrically opposed on the control plate 42 so that actuation of the throttle assembly 24 by the throttle control lever 22 through the throttle control cables 26, 28 requires rotation of the control plate 48.

The means for locking the control plate 42 against rotation, and thereby limiting throttle actuation, operates as a function of the operational status of the trolling valve 36. Preferably, the means for locking and releasing the control plate 42 utilizes the interaction of at least one cam slider 50 that slides in conjunction with trolling valve actuation in a control slot 52 formed in the control plate 42 to either permit or prevent rotation of the control plate 42, depending on the relative location of the cam slider 50. The cam slider 50 is slidingly mounted to the control plate 42 and is moved by the actuation of the trolling valve control cables 38, 40.

Figure 3:
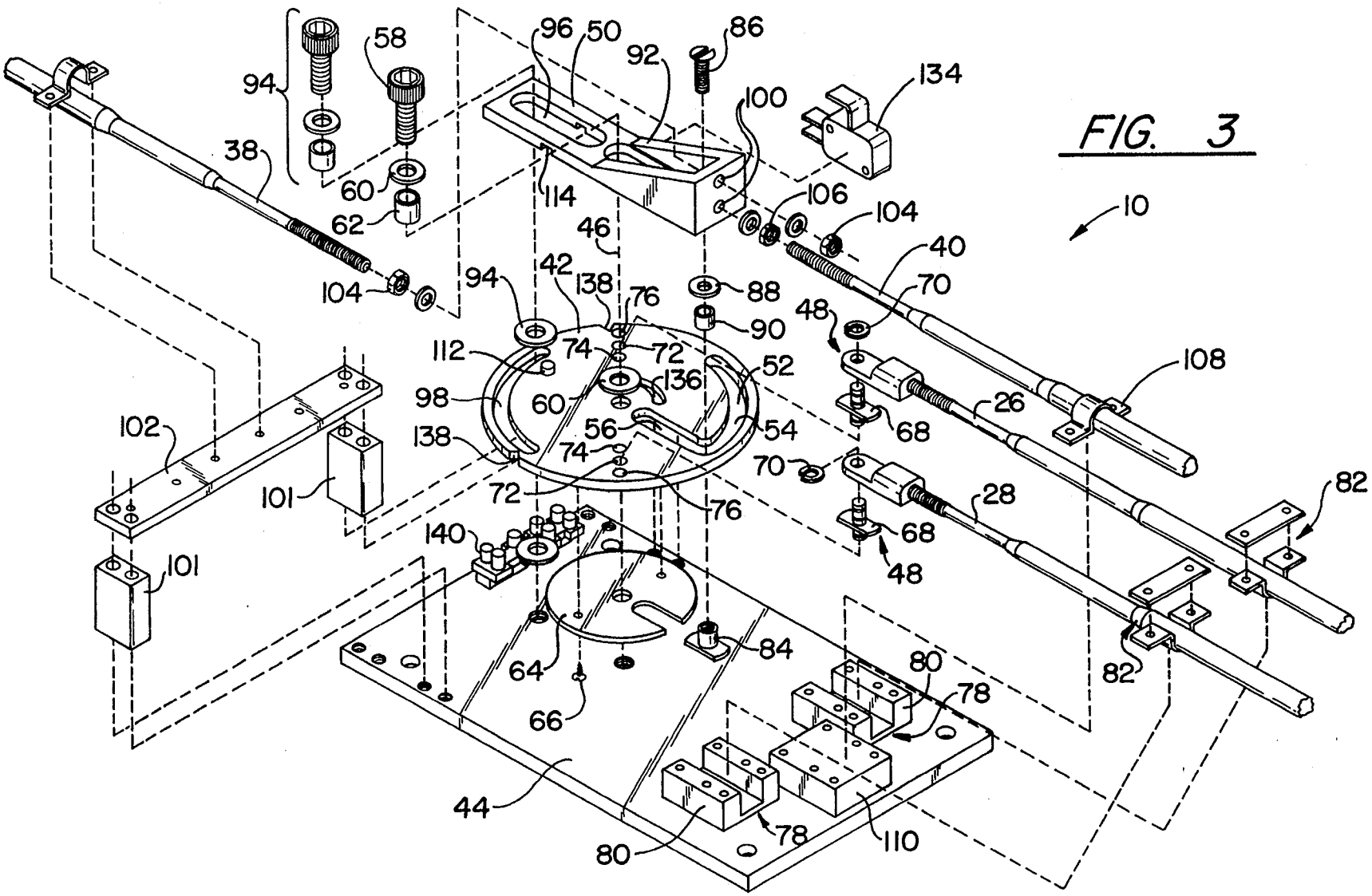
FIG. 3 is an exploded perspective view of a preferred mechanical embodiment of the trolling valve safety device.

Referring to FIG. 3, the trolling valve safety device 10 can be constructed to operate solely on mechanical input and output through the throttle control cables 26, 28 and the trolling valve control cables 38, 40. The control slot 52 includes a releasing arcuate slot 54 about the central pivot axis 46. The arc of the arcuate slot 54 can range in angle depending on the amount of rotation of the control plate 42 required. The control plate rotation is in turn dependent on the length of motion in the throttle control cables 26, 28. Preferably, the arc is approximately 62 degrees to correspond to the rotational motion associated with a standard 3 inch motion of the throttle control cables 26, 28. At one end of the slot arc, the control slot 52 transitions to a locking radial slot 56 extending toward the central pivot axis 46.

In a preferred embodiment, the control plate 42 is pivotally mounted to the support by a central bolt 58 and washer 60, and the bolt 58 is surrounded by a nylon bearing sleeve 62 to facilitate rotation. A low-friction slide plate 64 is preferably sandwiched between the support 44 and the control plate 42 to improve the motion between the control plate 42 and the support 44. The slide plate 64 can be mounted to the control plate 42 by screws 66.

The control plate 42 permits actuation of the engine throttle assembly 24 through rotation. The throttle control cable 26 from the throttle control is mounted diametrically opposite the throttle control cable 28 to the engine throttle assembly so that transmission of the cable motion occurs through rotation of the control plate 42.

The throttle control cables 26, 28 are each preferably mounted on a cable mount post 68 and secured by a clip 70. According to one aspect of the invention, the control plate 42 can provide a plurality of post mount holes so that the relative position of the cable mount posts 68 to the central pivot axis 46 can be varied. The central mount holes 72 are preferably spaced equidistantly about 3 inches from the central pivot axis 46. The inner holes 74 and the outer holes 76 can be positioned approximately ⅛ inch radially away from the central holes 72. In this way, the sensitivity of the throttle control can be adjusted to suit the particularly needs and desires of the user. For example, the sensitivity of the throttle control can be increased by mounting the throttle control cable 28 from the throttle control to an inner hole 74 while the throttle control cable 28 to the throttle assembly is mounted on an outer hole . Through rotation of the control plate, a unit of liner motion of the control cable from the throttle control lever results in greater than a unit of linear motion in the control cable and the attached throttle assembly.

The throttle control cables 26, 28 can be securely positioned relative to the support 44 by adjustable cable mounting assemblies which preferably include mounting blocks 80 and clamps 82 that can be adjustably positioned along the mounting blocks 80 to accommodate varying cable rod lengths that may be presented by existing cables on the boat on which the trolling valve safety device 10 is installed.

To lock and release the control plate 42 as a function of the operational status of the trolling valve, a cam member 84 is selectively positioned in either the releasing arcuate slot 54 or the locking radial slot 56. The positioning of the cam member 84 can be linked to the status of the trolling valve by mounting the cam member 84 to the cam slider 50, which slides when the trolling valve is actuated by the trolling valve control cables 38, 40. The cam slider 50 is slidingly mounted on the control plate 42 but is rotational fixed relative to the support 44. The cam slider 50 links the trolling valve control cable 38 from the trolling valve control at the helm to the trolling valve control cable 40 connected to the trolling valve on the marine gear and is slid in its travel path by actuating motion of the trolling valve control cables 38, 40.

The cam member 84 can be mounted to the cam slider 50 by machine screw bolt 86 and washer 88 and is preferably surrounded by a nylon bearing 90 to facilitate sliding in the control slot 52. The cam slider 50 can be secured to the control plate 42 by the central bolt 58, but is free to slide relative to the central bolt 58. The nylon bearing sleeve 62 is therefore preferably positioned around the shaft of the central bolt 58 to slidingly engage a slot 92 in the cam slider 50.

The cam slider 50 preferably does not rotate relative to the support 44. A secondary bolt 94 and bearing sleeve assembly 94 preferably mounts through a second slot 96 in the cam slider 50 to the underlying support 44 and prevents rotation of the cam slider 50. This bolt and sleeve assembly 94 also extends through a second slot 98 in the control plate 42 and can thereby assists in balancing the control plate 42 and its rotation.

The cam slider 50 can provide mounts, such as cable holes 100, for connection to the trolling valve control cables 38, 40. The trolling valve control cable 38 from the trolling valve control can be secured to the support 44 on a mounting bridge 102 that can be positioned on the support 44 through bridge mounting blocks 101. The trolling valve control cable 38 can have a threaded end to secure to the cam slider 50 with nut 104. The other trolling valve control cable 40 to the trolling valve assembly can similarly connect with nuts 106 and mount on the support 44 through a clamp 108 and an adjustable mounting block 110.

The means for locking can include a stop pin 112 extending upwardly from the control plate 42. When the trolling valve is disengaged, the cam slider 50 is preferably positioned relative to the control plate 42 so that a curved channel 114 aligns with the stop pin 112. When the control plate 42 rotates, the stop pin 112 passes through the channel 114. However, when the trolling valve is engaged, the cam slider 50 is moved and the channel 114 is not aligned with the stop pin 112. The stop pin 112 engages a side of the cam slider 50 and prevents the control plate 42 from rotating.

The stop pin 112 is located a fixed distance from the pivot axis 46 and provides a constant resisting moment against any turning moment generated by the throttle control cables 26, 28 when the stop pin 112 is disaligned with the channel 114. This constant resisting moment assists in preventing rotation of the plate 42, particularly when the close proximity of the cam member 84 to the pivot axis 46 trolling valve actuation results in a smaller resisting moment by the cam member 84.

Figure 4:
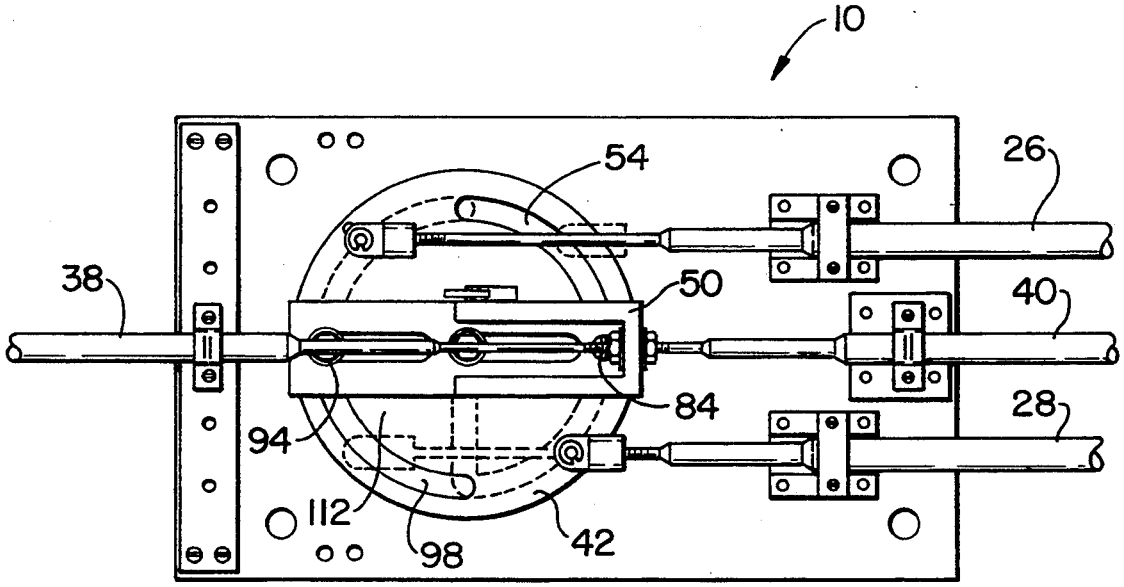
FIG. 4 is a top plan view of a preferred embodiment of the trolling valve safety device in a released configuration.

Referring to FIG. 4, when the trolling valve is not being used, the trolling valve control cables 38, 40 position the cam slider 50 so that the cam member 84 aligns with the releasing arcuate slot 54 and the stop pin 112 aligns with the channel 114, allowing rotation of the control plate 42 and normal throttle operation. The throttle control cables 26, 28 are therefore able to move from the idle position, shown in solid line, to a "full" throttle position, depicted in broken line. The secondary bolt assembly 94 slides freely relative to the secondary slot 98 and does not impede rotation of the control plate.

Figure 5:
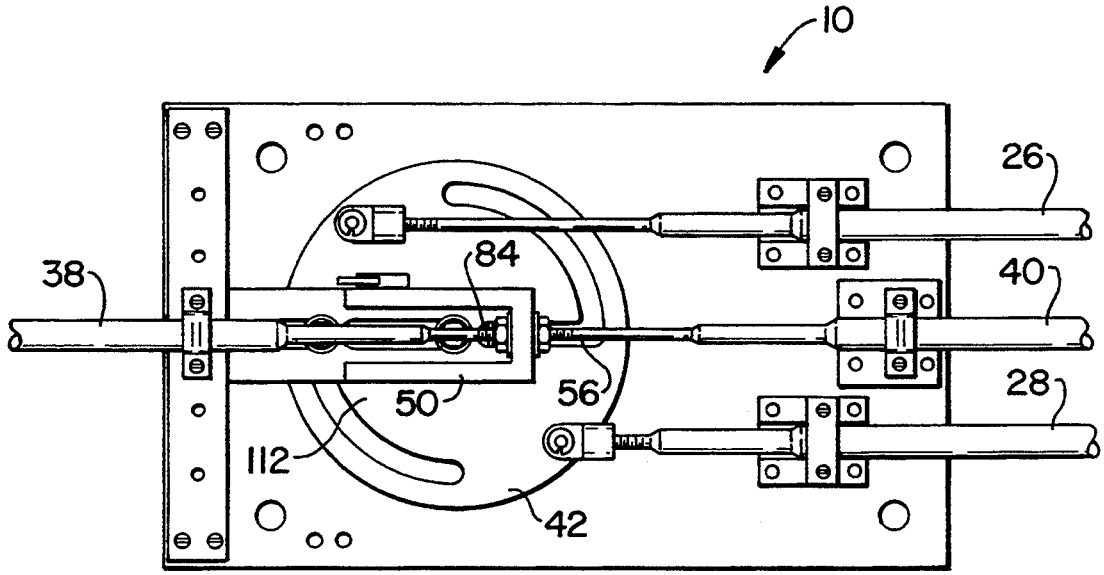
FIG. 5 is a top plan view of a preferred embodiment of the trolling valve safety device in a locked configuration.

Referring to FIG. 5, when the trolling valve is engaged, the cam slider 50 is positioned by the trolling valve control cables 38, 40 so that the cam member 84 is located in the locking radial slot 56. The engagement of the locking radial slot 56 with the cam member 84 prevents rotation of the control plate 42 and associated throttle actuation. Correspondingly, the control cables 26, 28 for the throttle must be in an idle position for the cam member 84 to align with the locking radial slot 56 and permit actuation of the trolling valve.

Figure 6:
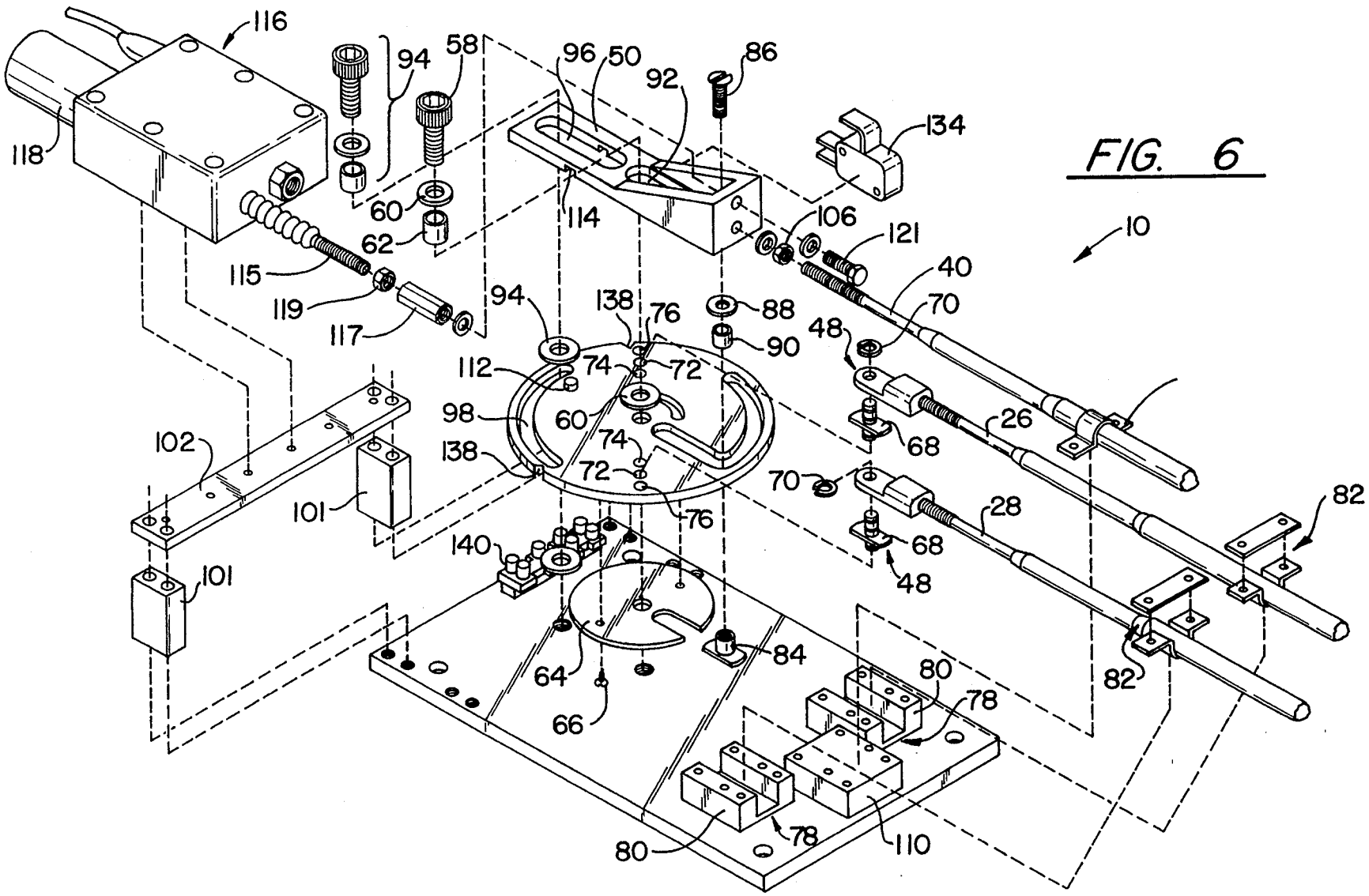
FIG. 6 is an exploded perspective view of a preferred electromechanical embodiment of the trolling valve safety device.

Referring to FIG. 6, the trolling valve safety device 10 can include an electromechanical actuator 116 for the trolling valve. The electromechanical actuator 116 can be of a type known in the art, in which a reversible motor 118 drives an internal cam slider 50 screw drive to advance and retract an internal trolley connected to the cam slider 50. The control cable 115 can be secured to the cam slider 50 by an adjustable threaded sleeve 117 limited by a nut 119 and mounted by a bolt 121. The range of motion of the cable 115 can be limited by internal trip switches in the actuator 116.

Figure 7:
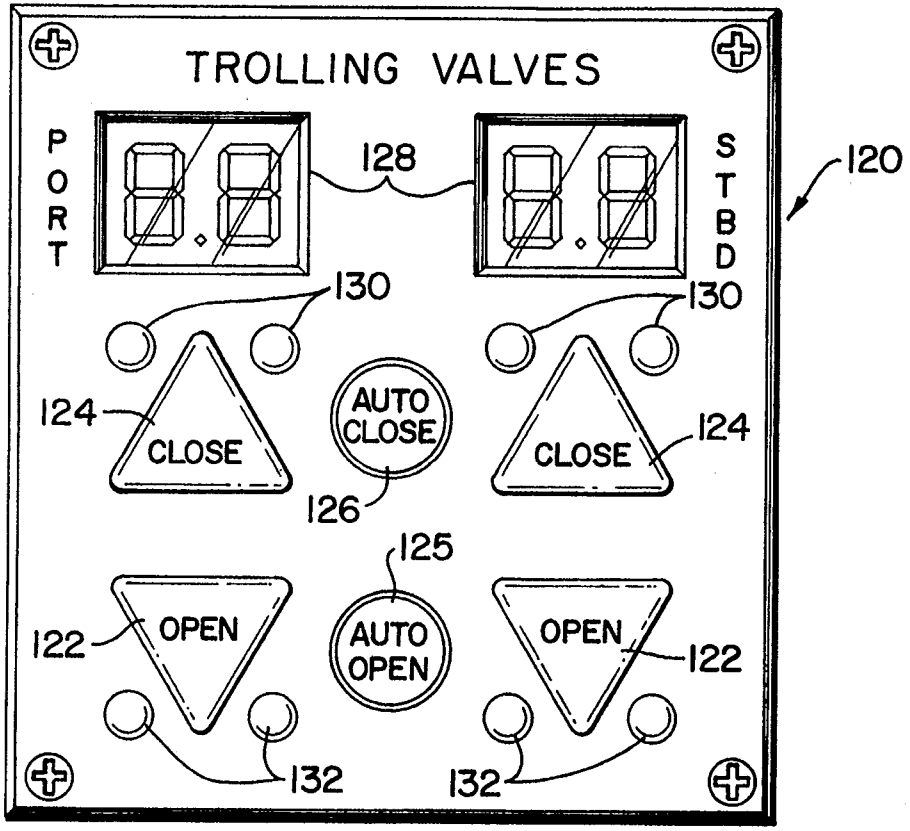
FIG. 7 is a top plan view of a trolling valve control pad; for use with the trolling valve safety device.

Referring to FIG. 7, the electromechanical actuator for the trolling valve can be controlled at the helm or other station on the boat by a electronic control pad 120 including touch controls for operating an underlying circuit board. The control pad can include a "close" control 124 and an "open" control 122 for each of starboard and port engine gear trolling valves. The respective controls 122, 124 can be electronically configured to send a signal to either a starboard or port trolling valve safety device electromechanical actuator to correspondingly advance or retract the cam slider and the associated control cable for the appropriate trolling valve. The "open" controls 122 and the "close" controls 124 can be configured to send a signal only so long as they are depressed, thereby enabling variable positioning of the trolling valves and obtaining the associated boat speed. The control pad 120 can further provide an "auto open" control 125 and an "auto close" control 126 for sending a continuous signal to respectively open and close the trolling valves without constant control pad depression.

The control pad 120 can include digital number displays 128 to indicate the position of the trolling valves along an arbitrary number scale. The displays 128 are preferably LCD. For example, a closed trolling valve could correspond to a reading of 0.0 while a fully open trolling valve position would cause a display of 3.0, with one-tenth increments in between to signify corresponding intermediate positions. To electronically signal the position of the trolling valve to the control pad 120, the actuator can be equipped with a sliding linear potentiometer to emit a signal corresponding to the position of the actuator trolley.

The control pad 120 can also include trolling valve status indicators, such as red LEDs 132, to signify that the trolling valve is engaged and that throttling is prevented, and green LEDs 130, to advise that the trolling valves are closed and that throttling is permitted.

Referring again to FIG. 6, the status of the trolling valve can be electronically signalled by a switch 134 mounted to the cam slider 50. When the cam slider 50 is positioned to place the cam member 84 in the locking radial slot 56, a switch pin (not shown) on the underside of the switch 134 is disaligned with a groove 136 in the control plate 42 and is depressed by the surface of the control plate. This depressed status can send a signal to the control pad 120 to illuminate the red "lock" indicators 132 (FIG. 7). When the cam slider 50 is positioned to place the cam member 84 in the releasing arcuate slot 54, the switch pin on the underside of the switch 134 is aligned with the groove 136 in the control plate 42 and is released during all phases of rotation of the control plate 42. This released status can send a signal to the control pad 120 to illuminate the green "released" indicators 130 (FIG. 7).

The switch 134 can also control other electronic components which are to be coordinated to the trolling valve status and the throttle status. Additional switches (not shown) can be positioned along the periphery of the control plate 42 and activated by alignment with switch notches 138 on the edge of the control plate 42. The various wiring for the switches can be organized and joined at a terminal block 140.

Figure 8:
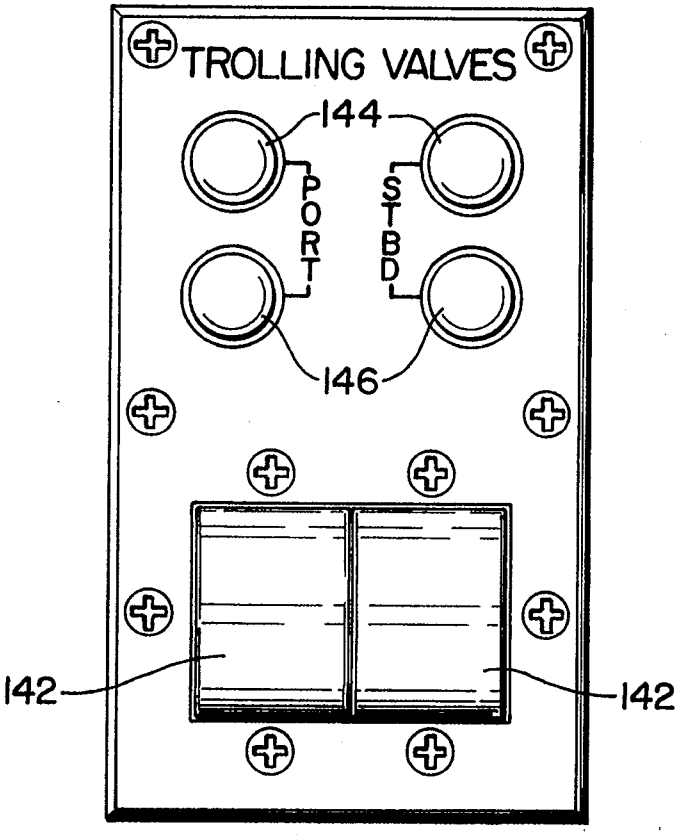
FIG. 8 is a top plan view of an alternative trolling valve control for use with the trolling valve safety device.

Referring to FIG. 8, the electromechanical actuator can alternatively be controlled by manual rocker switches 142 directed wired to the actuator. Indicator lamps 144, 146 can advise of the trolling valve status in a manner similar to that discussed above.

Although preferred embodiments have been described with a relatively high degree of particularity, it is intended that such description will enable those skilled in the art to make and use the invention and not define the scope of the invention. Instead, the scope of the invention should be determined from a reasonable interpretation of the following claims.

I claim:

1. A boat engine trolling valve safety device for limiting changes in the boat engine throttle position during use of a trolling valve on the boat marine gear, said device comprising:

means for releasably limiting boat throttle actuation to a level no higher than a predetermined burnout threshold for the marine gear; and means for locking said limiting means when the trolling valve is engaged and releasing the limiting means when the trolling valve is disengaged, wherein the limiting means rotates about a central pivot axis when released and provides diametrically opposed mounts for throttle control cables for actuating the engine throttle through rotation of the limiting means, said locking means preventing the limiting means from rotating when the trolling valve is engaged.

2. The safety device according to claim 1, wherein the locking means releasably locks the limiting means in a position corresponding to an idling position of the throttle.

3. The safety device according to claim 1, wherein said level is one quarter of full throttle for the boat engine.

4. The safety device according to claim 1, wherein said limiting means prevents actuation of the boat throttle when locked.

5. A boat engine trolling valve safety device for limiting changes in the boat engine throttle position during use of a trolling valve on the boat marine gear, said device comprising:

means for releasably limiting boat throttle actuation to a level no higher than a predetermined burnout threshold for the marine gear; and means for locking said limiting means when the trolling valve is engaged and releasing the limiting means when the trolling valve is disengaged, wherein the locking means is slidable by a cable that controls the trolling valve between a locking position in which the limiting means is locked and a releasing position in which the limiting means is released.

6. A boat engine trolling valve safety device for limiting changes in the boat engine throttle position during use of a trolling valve on the boat marine gear, said device comprising:

means for releasably limiting boat throttle actuation to a level no higher than a predetermined burnout threshold for the marine gear; and means for locking said limiting means when the trolling valve is engaged and releasing the limiting means when the trolling valve is disengaged, wherein the locking means is slidable between a locking position in which the limiting means is locked and a releasing position in which the limiting means is released, further comprising an electromechanical actuator and wherein the locking means is slid by said electromechanical actuator.

7. A boat engine trolling valve safety device for limiting changes in the boat engine throttle position during use of a trolling valve on the boat marine gear, said device comprising:

means for releasably limiting boat throttle actuation to a level no higher than a predetermined burnout threshold for the marine gear; and means for locking said limiting means when the trolling valve is engaged and releasing the limiting means when the trolling valve is disengaged, wherein the locking means is slidable between a locking position in which the limiting means is locked and a releasing position in which the limiting means is released, wherein the locking means includes a cam slider with an extending cam and the limiting means includes a control plate having a slot that receives the cam.

8. The safety device according to claim 7, wherein the control plate is circular.

9. The safety device according to claim 7, wherein a releasing portion of said slot is arcuate about the central pivot axis and a locking portion is radial to the central pivot axis.

10. A boat engine trolling valve safety device for limiting changes in the boat engine throttle position during use of a trolling valve on the boat marine gear, said device comprising:

means for releasably limiting boat throttle actuation to a level no higher than a predetermined burnout threshold for the marine gear; and means for locking said limiting means when the trolling valve is engaged and releasing the limiting means when the trolling valve is disengaged, wherein the locking means includes a cam slider having an arcuate channel about the central pivot axis and the limiting means includes a control plate, said cam slider being mounted on the control plate, said control plate having a stop pin extending on the side of the plate to which the cam slider is mounted, wherein the stop pin and the arcuate channel can align to permit rotation of the central plate and the cam slider is slidable to disalign the stop pin and the arcuate channel to thereby limit rotation of the control plate.

11. A boat engine trolling valve safety device for limiting changes in the boat engine throttle position during use of a trolling valve on the boat engine gear, said lock comprising:

a support;

a circular control plate mounted on said support so that said plate can rotate about a central pivot axis, said plate having a releasing arcuate slot diametrically said releasing arcuate slot extending at one of its ends to a locking radial slot directed toward the central pivot axis;

a cam slider slidably mounted on the control plate, said cam slider being fixed against rotation relative to the support, said cam slider providing a cam member which is inserted in said releasing arcuate slot, said cam member being fixed to said cam slider so as to permit sliding motion of said cam slider when said cam member is aligned with the radial slot and travels therein and to limit said sliding motion when said cam member is not aligned with the radial slot;

said control plate having cable mounts on opposite sides of the central pivot axis for connection to first and second control cables for the engine throttle, whereby throttle actuating motion of said first cable is transmitted to said second cable, and thereby to the engine throttle, through rotation of the control plate;

said cam slider being connectable to third and fourth control cables for the trolling valve, whereby trolling valve actuating motion of said third cable is transmitted to said fourth cable, and thereby to the trolling valve, through sliding motion of the cam slider;

wherein said cam member is aligned with the radial slot when the engine throttle is in an idle position and said cam member is urged into the radial slot by actuation of the trolling valve, thereby limiting movement of the engine throttle when the trolling valve is actuated.

* * * * *